United States Patent [19]

Hatakeyama

[11] Patent Number: 4,784,930

[45] Date of Patent: Nov. 15, 1988

[54] ELECTROSTATOGRAPHIC ENCAPSULATED TONER

[75] Inventor: Akira Hatakeyama, Fujinomiya, Japan

[73] Assignee: Fuji Photo Film Co., Ltd., Kanagawa, Japan

[21] Appl. No.: 8,304

[22] Filed: Jan. 29, 1987

[30] Foreign Application Priority Data

Jan. 29, 1986 [JP] Japan ..... 61-17264

[51] Int. Cl.[4] ..... G03G 9/16

[52] U.S. Cl. ..... 430/138; 430/106.6

[58] Field of Search ..... 430/108, 106.6, 138

[56] References Cited

U.S. PATENT DOCUMENTS 4,622,281 11/1986 Imai et al. ..... 430/106.6
4,623,603 11/1986 Iimura et al. ..... 430/106.6
4,629,673 12/1986 Osawa et al. ..... 430/106.6

*Primary Examiner*—John L. Goodrow
*Attorney, Agent, or Firm*—Jules E. Goldberg

[57] ABSTRACT

An electrostatographic encapsulated toner for pressure fixing process comprising a core material which comprises a binder, a colorant and a magnetizable particle, said binder comprising a polymer and an oily liquid capable of dissolving or swelling said polymer, and a shell enclosing said core material, characterized in that a surface of the magnetizable particle is coated with a polymer being essentially insoluble in the oily liquid.

6 Claims, No Drawings

ELECTROSTATOGRAPHIC ENCAPSULATED TONER

BACKGROUND OF THE INVENTION

1. Field of the Invention

The present invention relates to an electrostatographic encapsulated toner employable for producing a visible image from a latent image in an electrostatographic recording method.

2. Description of Prior Arts

As the process for fixing a toner image in a recording method such as electrostatography, there have been known three fixing processes, that is, a heat fixing process, a solvent fixing process and a pressure fixing process. Recently, the heat fixing process and the pressure fixing process, both using no solvent, are widely used from the viewpoint of the prevention of environmental pollution.

In the heat fixing process, a toner comprising a colorant bound with a binder has been conventionally employed. The same kind of toner is also employed in the pressure fixing process, but utilization of an encapsulated toner is recently proposed in the pressure fixing process.

The encapsulated toner is a toner in the form of micro-capsule prepared by enclosing a core material comprising a colorant such as carbon black and a binder with a resin shell which is rupturable by the application of pressure.

The conventional encapsulated toner is not necessarily satisfactory in various properties that are essentially required for a toner employable in the electrostatography.

In more detail, a toner employable as a developing agent in electrostatography is required to have various excellent properties such as high powder flowability, high developing efficiency, and no smearing of the surface of a photosensitive medium for producing a latent image. Further, in the case of a two-component developing process, it is necessary that the toner does not smear the surface of the employed carrier. In the pressure fixing process, high fixability, little occurrence of off-setting phenomenon on a pressure roller used in the process (namely, toner adheres to the surface of a pressure roller to stain the roller), etc. are also required for the toner.

Accordingly, the toner employed in the pressure fixing process should be satisfactory in all properties such as powder flowability, fixability to a supporting medium (e.g., paper), preservation stability of the fixed image, anti-offsetting property, and electrostatic chargeability and/or conductivity required depending upon a developing process. However, the conventional toners are not well satisfactory in the above-mentioned characteristics.

For instance, in an encapsulated toner (i.e., toner in the form of micro-capsule) containing magnetizable particles, the surface of the magnetizable particle is hydrophilic, while the core material is lipophilic. Therefore, the magnetizable particles are liable to move into the shell, while the particles should be present inside of the core material. Further portions of the particles tend to be exposed outside of the shell. For this reason, the shell is insufficient in the denseness, and accordingly it is difficult for the shell to prevent volatilization of the oily liquid from the core material (i.e., phenomenon that the oily liquid in the core portion passes through the shell to excape in storage of the encapsulated toner). If the oily liquid in the core material volatilizes, the encapsulated toner shows unsatisfactory fixability. That is, such toner is apt to deteriorate with time in the fixability even if the toner has well fixability just after the toner is prepared. For improving the above-mentioned disadvantage, U.S. Pat. No. 4,307,169 has proposed a method of coating the surface of the magnetizable particle with a polymer to make the particle lipophilic. However, the present inventor has found that thus coated polymer is easily dissolved in the oily liquid employed in the core material as a binder component. Hence, the effect given by coating the surface of the magnetizable particle with such polymer is unsatisfactory, and therefore the fixability of the encapsulated toner is not sufficiently improved. Further, the powder flowability of such toner tends to deteriorate particularly after a lapse of time.

SUMMARY OF THE INVENTION

It is an object of the present invention to provide an electrostatographic encapsulated toner which is improved in fixability.

Particularly, it is an object of the invention to provide an electrostatographic encapsulated toner retaining high fixability even after a lapse of time.

There is provided by the present invention an electrostatographic encapsulated toner comprising a core material which comprises a binder, a colorant and a magnetizable particle, said binder comprising a polymer and an oily liquid capable of dissolving or swelling said polymer, and a shell enclosing said core material, which is characterized in that a surface of said magnetizable particle is coated with a polymer being essentially insoluble in the oily liquid.

In the encapsulated toner of the invention, the surface of the magnetizable particle contained in the core material is coated with a polymer which is essentially insoluble in the oily liquid employed as binder component, so that the magnetizable particles are very rarely moved into the shell or outside of the shell, but remains stably within the core portion. Accordingly, the shell has high denseness, and thereby the oily liquid hardly volatilizes out of the shell. As a result, the encapsulated toner of the invention is improved in the fixability and retains high fixability particularly even after a lapse of time.

Further, the encapsulated toner of the invention is excellent in powder flowability and retains high flowability particularly even after a lapse of time.

DETAILED DESCRIPTION OF THE INVENTION

The encapsulated toner of the invention has a basic structure comprising a core material and a shell enclosing the core material. The core material of the encapsulated toner of the invention comprises a binder comprising a polymer and an oily liquid, a colorant and a magnetizable particle.

There is no specific limitation on the polymer which is a binder component contained in the core material of the encapsulated toner according to the invention.

Examples of the polymer include polyolefin, olefin copolymer, styrene resin, styrene-butadiene copolymer, epoxy resin, polyester, rubbers, polyvinylpyrrolidone, polyamide, coumarone-indene copolymer, methyl vinyl ether-maleic anhydride copolymer, amino resin, polyurethane, polyurea, polyisobutyl methacrylate, polyethylene glycol dimethacrylate, homopolymers or copolymers of acrylic acid esters, acrylic acid-long chain alkyl methacrylate copolymer oligomer, polyvinyl acetate, and polyvinyl chloride. These polymers can be employed singly or in combination.

Among these polymers, preferably employed as a polymer for the binder are polyisobutyl methacrylate, polyethylene glycol dimethacrylate, and polyacrylate, and copolymers of acrylic acid esters with other copolymerizable polymers.

The oily liquid employable for the binder is a high-boiling solvent capable of dissolving or swelling the above-described polymer and having a boiling point of not lower than 150° C. (hereinafter referred to simply as a high-boiling solvent). Examples of the high-boiling solvent include phthalic acid esters such as diethyl phthalate and dibutyl phthalate; aliphatic dicarboxylic acid esters such as diethyl malonate and dimethyl oxalate; phosphoric acid esters such as tricresyl phosphate and trixylyl phosphate; citric acid esters such as O-acetyl triethyl citrate and tributyl citrate; benzoic acid esters such as butyl benzoate and hexyl benzoate; aliphatic acid esters such as hexadecyl myrestate and dioctyl adipate; alkylnaphthalenes such as methylnaphthalene, dimethylnaphthalene, monoisopropylnaphthalene and diisopropylnaphthalene; dialkylphenyl ethers such as di-o-methylphenyl ether, di-m-methylphenyl ether and di-p-methylphenyl ether; amides of higher fatty acids or aromatic sulfonic acids such as N,N-dimethyllauroamide and N-butylbenzenesulfonamide; trimellitic acid esters such as trioctyl trimellitate; and diarylalkanes such as diarylmethanes (e.g., dimethylphenylphenylmethane) and diarylethanes (e.g., 1-phenyl-1-methylphenylethane, 1-dimethylphenyl-1-phenylethane and 1-ethylphenyl-1-phenylethane). These high-boiling solvents can be employed singly or in combination.

As the oily liquid, there can be also employed an organic solvent substantially not dissolving or swelling the aforementioned polymer and having a boiling point of 100°-250° C. (hereinafter also referred to simply as a low-boiling solvent) in addition to the above-mentioned high-boiling solvent.

Examples of the low-boiling solvent include saturated aliphatic hydrocarbons and organic liquid mixtures mainly containing saturated aliphatic hydrocarbons.

The ratio of the low-boiling solvent to the high-boiling solvent can be optionally selected, but preferably is in the range of from 9/1 to 1/9 (high-boiling solvent/-low-boiling solvent), by weight.

The binder employed in the invention preferably has a composition comprising the above-mentioned polymer and high-boiling solvent. Also preferred is a binder having a composition comprising the above-mentioned polymer, high-boling solvent and low-boiling solvent.

The ratio of the polymer to the high-boiling solvent is desirably in the range of 0.1 to 100 (polymer/high-boiling solvent), by weight. The ratio of a combination of the polymer and the high-boiling solvent to the low-boiling solvent is also desirably in the range of 0.1 to 100 (combination of polymer and high-boiling solvent/low-boiling solvent), by weight.

As a colorant contained in a conventional toner for the electrostatography, generally employed are a black toner such as carbon black or graft carbon black and a chromatic toner such as a blue, red or a yellow colorant. These conventional colorants can be also employed in the encapsulated toner of the invention.

As the magnetizable particles contained in the core material of the encapsulated toner according to the invention, there can be employed magnetizable particles (particulate material capable of being magnetized) empolyable for a conventional magnetic toner. Examples of the magnetizable particles include particles of a simple metal (e.g., cobalt, iron, or nickel), an alloy and a metallic compound. In the case of using a chromatic magnetizable powder such as a powder of black magnetite, the chromatic magnetizable powder can serve as both of a magnetizable particle and a colorant.

The magnetizable particle contained in the core material of the encapsulated toner according to the invention is characterized in that its surface is coated in advance with a polymer. The polymer to be coated over the surface of the magnetizable particle (hereinafter also referred to simply as a surface-coating polymer) is essentially insoluble in the above-mentioned high-boiling solvent employed as a binder component. If the polymer is soluble in the high-boiling solvent, the coated polymer on the magnetizable particle is dissolved in the high-boiling solvent in the preparation of an encapsulated toner so as not to give an effect by coating the surface of the magnetizable particle. Examples of the surface-coating polymer include polymethyl methacrylate, polyacrylonitrile, polyamide, vinylidene chloride, polyester, epoxy resin, polyacetal resin and melamine resin. The surface-coating polymer preferably has the same repeating monomer unit as that of the above-mentioned polymer for the binder.

For coating the surface of the magnetizable particle with the polymer, there can be used conventional methods such as a method of subjecting a monomer to polymerization reaction on the surface of the magnetizable particle to form a coated layer of the polymer over its surface or a method of immersing the magnetizable particle in a solution containing the polymer in an appropriate solvent and then drying the magnetizable particle to form a layer of the polymer on the surface of the magnetizable particle.

As described hereinbefore, there are such correlation among the surface-coating polymer for the magnetizable particle, the polymer for the binder and the high-boiling solvent for the binder employed in the invention that the surface-coating polymer is substantially insoluble in the high-boiling solvent, and the polymer for the binder is dissolved or swelled in the high-boiling solvent. Examples of the combination of the surface-coating polymer (A), polymer for the binder (B) and the high-boiling solvent (C) satisfying the above conditions include a combination of polymethyl methacrylate (A), polyisobutyl methacrylate (B) and 1-isopropylphenyl-2-phenylethane (C), and a combination of polyacrylonitrile (A), polyisobutyl methacrylate (B) and 1-isopropylphenyl-2-phenylethane (C).

There is no specific limitation with respect to the resin employable for producing a shell of the encapsulated toner. From the viewpoint of various properties required for an encapsulated toner, preferred are polyurethane resin, polyurea resin, polyamide resin and epoxy resin. These resins can be employed singly or in combination.

The process for the preparation of the encapsulated toner of the invention will be described below in more detail by referring to a process for the preparation of an encapsulated toner comprising a shell of polyurethane resin, polyurea resin or polyamide resin.

In the preparation of an encapsulated toner, there can be utilized a conventional process comprising the steps of producing micro-capsules by forming a shell around a core material in an aqueous liquid through an interfacial polymerization or an outer polymerization, particularly producing micro-capsules based on the polymerization reaction, and washing the micro-capsules with water.

As a shell-forming method for producing micro-capsules having a shell of polyurethane resin or polyurea resin, an interfacial polymerization is employed.

A shell of polyurea resin and/or polyurethane resin is easily prepared as a shell of micro-capsules by subjecting polyisocyanate (e.g., diisocyanate, triisocyanate, tetraisocyanate and polyisocyanate prepolymer) to the interfacial polymerization reaction with polyamine (e.g., diamine, triamine and tetraamine), prepolymer having two or more amino groups, piperazine and derivatives thereof, or polyol in an aqueous solvent.

A shell composed of a complex layer comprising a polyurethane resin and/or a polyurea resin and a polyamide resin (e.g., a complex layer comprising a polyurethane resin and a polyamide resin, a complex layer comprising a polyurea resin and a polyamide resin, or a complex layer comprising a polyurethane resin, a polyurea resin and a polyamide resin) can be prepared by the following process.

In the case of a shell composed of a complex layer comprising a polyurethane resin and a polyamide resin, the shell can be prepared by the interfacial polymerization comprising the steps of adjusting pH of an emulsion medium for forming a reaction liquid and heating the reaction liquid, using a combination of polyisocyanate and acid chloride, polyamine and polyol. In the case of a shell composed of a complex layer comprising a polyurea resin and a polyamide resin, the shell can be prepared by the interfacial polymerization comprising the steps of adjusting pH of an emulsion medium for forming a reaction liquid and heating the reaction liquid, using a combination of polyisocyanate and acid chloride, and polyamine. Processes for preparing the above-mentioned shell of a complex layer comprising a polyurethane resin and a polyamide resin or a complex layer comprising a polyurea resin and a polyamide resin are described in detail in Japanese Patent Provisional Publication No. 58 (1983)-66948. The shell composed of such complex layer is particularly suitable for producing an encapsulated toner containing magnetizable particles in its core material. A monomer contributing to the polymerization reaction for forming a resin shell varies depending upon the shell-forming resin, but generally a combination of two or more monomers is employed. An example of such combination is a combination of at least one bifunctional group compound selected from the group consisting of isocyanate group, bischloroformate group, acid chloride group and sulfonylchloride group and at least one compound selected from the group consisting of water, polyvalent amine, polyhydric alcohol and polycarboxylic acid.

In the preparation of the encapsulated toner of the invention, micro-capsules can be produced by dispersing the core material comprising the aforementioned colorant, binder, magnetizable particles coated with a polymer, and one compound of shell-forming material in the form of droplet in an aqueous medium (containing other compound of shell-forming material), and then forming a shell of polyurethane or polyurea resin around the core material. Processes for the preparation of micro-capsules by forming a shell around the core material in the form of droplet are already known as described hereinbefore, and these known processes can be applied to the preparation of the encapsulated toner of the invention.

The micro-capsules prepared as above by forming the shell around the core material are separated from the liquid, and the separated micro-capsules are dried. The separating and drying the micro-capsules can be done by subjecting the obtained dispersion (or slurry) containing micro-capsules to a spray drying or a heat drying. There is no specific limitation on the apparatus or device employable in the drying process. Examples of the devices include an electric furnace, a muffle furnace, a hot plate, an electric dryer, a fluid-bed dryer and an infrared rays dryer.

The shell of the encapsulated toner of the invention may further contain other optional additives such as an electrostatic charge modifier (e.g., a dye containing metal and nigrosine) and solid particles (e.g., hydrophobic silica), if desired. Those additives can be incorporated into the shell in an optional stage of the process such as a shell-forming stage or other stage after the separation and drying procedure.

The example and the comparison examples of the present invention are given below.

EXAMPLE 1

To 400 g. of a 0.1 wt.% ethyl acetate solution of polymethyl methacrylate (molecular weight: 30,000) was added 40 g. of magnetite particles (trade name: EPT-1000, available from Dowa Iron Powder Co., Ltd.), and they were mixed. From the mixture was evaporated the ethyl acetate, and the mixture was pulverized to give magnetite particles having a coating layer of polymethyl methacrylate thereon.

30 g. of polyisobutyl methacrylate (trade name: Acrybase, MM-2002-2; mean molecular weight: 70,000, available from Fujikura Kasei Co., Ltd.) and 40 g. of 1-isopropyl-phenyl-2-phenylethane were mixed with 30 g. of the above-obtained magnetite particles in a sand mill, to prepare a dispersion (magnetizable ink).

Subsequently, to the dispersion (magnetizable ink) was added 4 g. of an addition product of 3 moles of xylylene diisocyanate and trimethylolpropane, and they were mixed to prepare an oily dispersion.

Independently, 2 g. of methylcellulose (methoxy group substitution degree: 1.75, mean molecular weight: 20,000, substitution degree of hydroxypropoxy group to methoxy group: 18%) was dissolved in 60 g. of water (20° C.) to prepare an aqueous solution.

In the aqueous solution was dropped little by little the above-prepared oily dispersion under vigorously stirring, to prepared an oil-in-water emulsion. The preparation of the emulsion was conducted by cooling the outside of the container to set the temperature of the solution in the container to 20° C. After the emulsion was prepared, the emulsion was further stirred, and 100 ml of diethylene triamine solution (concentration: 5 wt.%, temperature: 20° C.) was added to the emulsion. The temperature of the emulsion was gradually raised to 60° C. in 30 min.

Keeping the temperature of the emulsion at 60° C., a removing operation of the organic solvent from the emulsion was carried out under stirring the emulsion for 2 hours to complete the encapsulation. Thus obtained micro-capsule dispersion was subjected to centrifugal separation at 5,000 rpm so as to separate the micro-capsules from the aqueous solution containing methylcellulose. The obtained micro-capsule slurry was dispersed in water to prepare a 30 wt.% dispersion. The dispersion was then subjected to four times of washing procedures comprising centrifugal separation at 5,000 rpm and dispersing in water, to prepare a micro-capsule slurry. The slurry was then dried at 60° C. to obtain a powdery encapsulated toner having mean particle size of 12 μm.

It was confirmed that the obtained encapsulated toner particles were independent from each other and showed high flowability.

COMPARISON EXAMPLE 1

The procedure of Example 1 was repeated except for using magnetite particles having been not treated with polymethyl methacrylate, to prepare an encapsulated toner.

COMPARISON EXAMPLE 2

The procedure for the preparation of a dispersion (magnetizable ink) of Example 1 was repeated except for using magnetite particles having been treated with polyisobutyl methacrylate (molecular weight: 70,000) instead of polymethyl methacrylate, to prepare a dispersion (magnetizable ink).

Using the above-obtained dispersion, an encapsulated toner was prepared in the same manner as described in Example 1.

COMPARISON EXAMPLE 3

The procedure of Example 1 was repeated except for using polymethyl methacrylate (molecular weight: 30,000) as a polymer added to a dispersion (magnetizable ink) instead of polyisobutyl methacrylate, to prepare an encapsulated toner.

The encapsulated toners obtained in Example 1 and Comparison Examples 1 to 3 were evaluated on the pressure fixability according to the following test method.

A toner image (OD=1.20) produced on a paper support was fixed using a pressure fixing device comprising two rollers facing each other at a pressure of 180 kg/cm$^2$ to obtain a duplicate image. The duplicate image was examined on the density by measuring the density of solid black portion of the duplicate image by means of a Macbeth reflection densitometer.

Subsequently, after the duplicate image was rubbed with a sand rubber at seven times, the density of the duplicate image was examined in the same manner as described above. The fixability of the encapsulated toner immediately after the toner was prepared was determined by the ratio of the value measured before rubbing to that measured after seven times rubbing on the density of the duplicate image.

Further, the encapsulated toner was subjected to the same evaluation as described above after stored for 6 months in an atmosphere of 30° C. and 65% RH.

The results are set forth in Table 1.

TABLE 1

| | Immediately after Preparation | After Storage of 6 months |
|---|---|---|
| Example 1 | 0.88 | 0.87 |
| Com. Example 1 | 0.82 | 0.51 |
| Com. Example 2 | 0.83 | 0.66 |
| Com. Example 3 | 0.63 | 0.67 |

As is evident from Table 1, the encapsulated toner of the invention comprising a core material containing a binder composed of a polymer and an oily liquid capable of dissolving or swelling said polymer, a magnetizable particle coated with a polymer substantially insoluble in the oily liquid and a colorant was excellent in the fixability and retained high fixability particularly even after storage of a long period of time.

Further, the encapsulated toner of the invention was excellent in the flowability and retained high flowability particularly even after storage of a long period of time.

I claim:

1. In an electrostatographic encapsulated toner comprising a core material which comprises a binder, a colorant and a magnetizable particle, said binder comprising a polymer and an oily liquid capable of dissolving or swelling said polymer, and a shell enclosing said core material, the improvement wherein a surface of said magnetizable particle is coated with a polymer being essentially insoluble in the oily liquid.

2. The electrostatographic encapsulated toner as claimed in claim 1, wherein said polymer coated over the surface of the magnetizable particle has the same repeating monomer unit as that of the polymer contained in the binder.

3. The electrostatographic encapsulated toner as claimed in claim 1, wherein said polymer coated over the surface of the magnetizable particle is at least one polymer selected from the group consisting of polymethyl methacrylate and polyacrylonitrile.

4. The electrostatographic encapsulated toner as claimed in claim 1, wherein said polymer contained in the binder is at least one polymer selected from the group consisting of polyisobutyl methacrylate, polyethylene glycol dimethacrylate, polyacrylate, and copolymer of acrylate and other copolymerizable monomer.

5. The electrostatographic encapsulated toner as claimed in claim 1, wherein said oily liquid has a boiling point of not lower than 150° C.

6. The electrostatographic encapsulated toner as claimed in claim 1, wherein said oily liquid is diarylalkane.

* * * * *